United States Patent [19]

Orea Mateó

[11] 4,412,364

[45] Nov. 1, 1983

[54] PROCESS FOR THE NORMALIZED MANUFACTURE OF SHOES

[76] Inventor: Fernando Orea Mateo, Edificio Torres Blancas, Avda. América, 37-945 Madrid, Spain

[21] Appl. No.: 242,254

[22] Filed: Mar. 10, 1981

[30] Foreign Application Priority Data

Mar. 18, 1980 [ES] Spain ..... 489.711

[51] Int. Cl.[3] ..... A43D 3/00

[52] U.S. Cl. ..... 12/146 L; 12/133 R

[58] Field of Search ..... 12/146 R, 146 L, 133 R, 12/133 A, 133 B, 133 C, 133 M

[56] References Cited

U.S. PATENT DOCUMENTS

| | | | |
|---|---|---|---|
| 1,948,547 | 2/1934 | Topham | 12/146 L |
| 2,309,775 | 2/1943 | Levitt | 12/133 R |
| 2,514,518 | 7/1950 | Ryan | 12/146 L |
| 2,716,294 | 8/1955 | Schwartz et al. | 12/133 R |

*Primary Examiner*—Patrick D. Lawson

*Attorney, Agent, or Firm*—Wenderoth, Lind & Ponack

[57] ABSTRACT

A process for the normalized manufacture of shoes includes defining the measurements of the sole of a last, to determine the transverse contour thereof, by defining an axis transverse to the length of the sole at a position spaced one third of the length from the sole front. Four zones determined by three transverse lines equally spaced at a distance of 1/12 the length are defined forwardly of the transverse axis. The contour of the sole is determined along such lines to be flat at the line nearest to the front, to have an arch height of 1/120 the length at the following line and to have an arch height of 1/96 the length of the last line. Seven transverse lines, equally spaced at a distance 1/12 the length are defined rearwardly of the transverse axis. The contour of the sole is determined by the most forward such line to have an arch height of 1/96 the length, and to have at the remaining such lines arch heights of 1/60 the length.

6 Claims, 14 Drawing Figures

FIG.-5
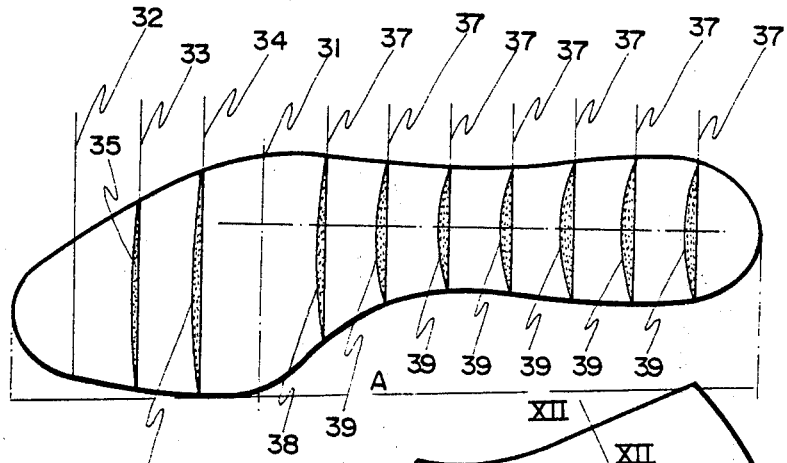
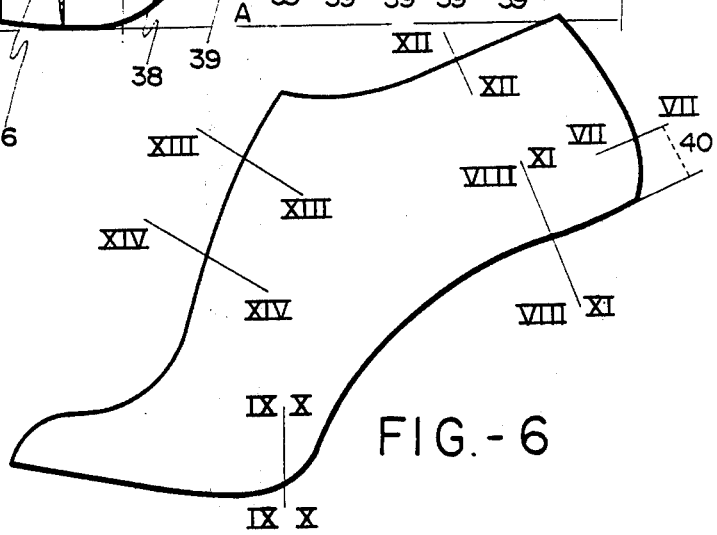
FIG.-6

PROCESS FOR THE NORMALIZED MANUFACTURE OF SHOES

BACKGROUND OF THE INVENTION

The present invention relates to a process for the normalized manufacture of shoes.

At present each shoe model has a graded range of sizes which are those generally and popularly known as "numbers." Each shoe "number" depends on the length thereof, and the remaining measurements thereof do not vary in practice when the length of the shoe changes. Thus, shoes having different lengths practically will have the same remaining measurements, i.e., width, mouth, vamp, etc. This fact has a negative bearing on users, producing discomforts and even deformations, inasmuch as the shoes do not properly adapt to the anatomy of the feet of the users.

On the other hand, a unitary production of a shoe does not take place in the shoe industry, since the majority of the companies in the industry concentrate on specific elements, such as inner sole makers, last makers, etc., and contribute their different articles to a subsequent finishing process. Since the measurements used are not common to all manufacturers, there is no doubt that the assembly cannot at all be absolutely perfect.

SUMMARY OF THE INVENTION

The present invention completely overcomes the above disadvantages, since it establishes a normalization of proportional measurements of shoes, which will enable manufacture of all the component parts thereof and naturally a finished product which will be in harmony, anatomically, with feet of different sizes.

A process for the normalization of the sizes of shoes is described in Spanish Pat. No. 486,567, which describes the fact that the main measurements of the last and of the heel are proportionally determined from measurements corresponding to the length of the sole and the height of the heel. Concretely, from these two main measurements the process of U.S. Pat. No. 486,567 contemplates a graphic drawing or contouring of the last and of the longitudinal profile of the heel. In the case of the last, the graphic contouring is made both for the lower longitudinal profile and the upper longitudinal profile.

The present invention mainly consists in that the transverse measurements of the sole and the primary measurements of the sections of the last corresponding to the edges thereof, also determined proportionally from the main measurement of the length of the sole. These edges are specifically those of the heel, the heel piece, the mouth, the flexing zone and the upper and the lower vamps.

Although the present invention specifically is directed only to the definition of the transverse measurements of the sole and of the sections of the last corresponding to the edges thereof, there is described herein the complete process for defining the remaining main measurements of the last and of the heel.

BRIEF DESCRIPTION OF THE DRAWINGS

For a better understanding of the characteristics of the process of the invention, references now will be made to the accompanying drawings, wherein:

FIG. 5 is a graphic plan view of the last illustrating the manner of definition of the sole thereof according to the invention;

FIG. 6 is a graphic elevational view thereof; and

DETAILED DESCRIPTION OF THE INVENTION

Figure 1:
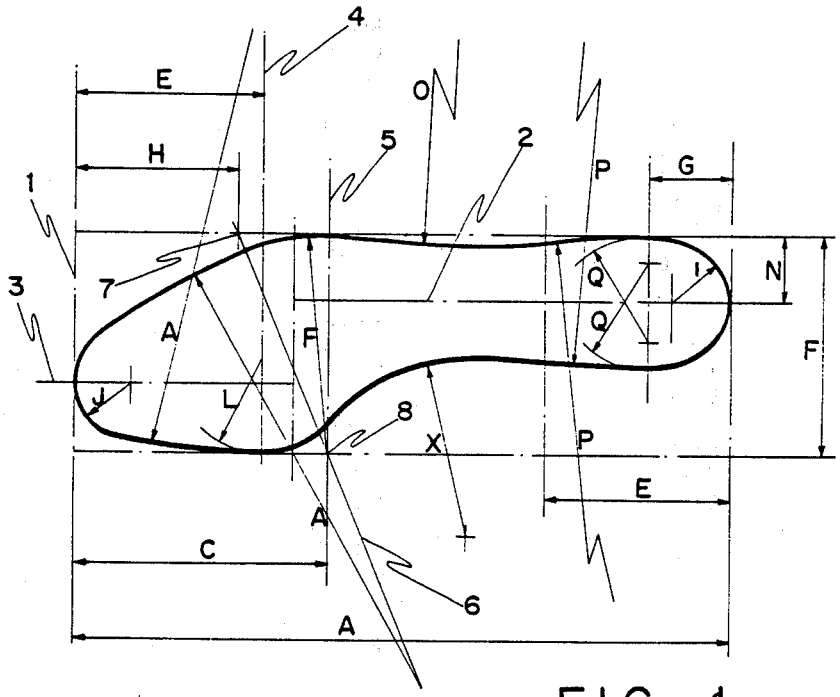
FIG. 1 is a graphic plan view of a last defined according to Spanish Pat. No. 486,567.

With reference to FIG. 1 of the drawings, it can be seen that the outline of the sole of the last is within a rectangle (1), the larger sides of which are equal to the desired length (A) of the last. The smaller sides of the rectangle (1) will have a magnitude (F) equal to $\frac{1}{3}$ of the length (A).

Through one of the smaller sides (F) of the rectangle (1) there is drawn a longitudinal axis (2) at a distance (N) from one of the larger sides (A). The distance (N) is equal to 1/10 of the length (A).

On the axis (2) there is positioned the center of an arc which corresponds to the rear portion of the heel and which has a radius (I), the value of which is equal to 1/11 of the length (A). This arc having a radius (I) is tangent to the point of intersection between the axis (2) and the rear small side (F) of the rectangle (1).

Subsequently a line is drawn perpendicular to the axis (2) at a distance (G) from the rear small side (F) of the rectangle (1), on which perpendicular are positioned the centers of two arcs each having a radius (Q) and extending tangent to the arch which forms the rear part of the heel and which has a radius (I). The distance (G) corresponds to a value equal to $\frac{1}{8}$ of the length (A).

Then another line perpendicular to the axis (2) is drawn at a distance (E) from the rear small (F) of the rectangle (1) equivalent to 2/7 of the length (A). On this second perpendicular are positioned the centers of the two new arcs each having a radius (P) equal to 5/3 that of (A) and extending tangent to a respective arc having a radius (Q).

The basic outline of the heel is formed by drawing the arcs having the radii (I), (Q) and (P).

Once the basic outline of the heel is drawn, a longitudinal axis (e) is drawn at the front zone of the main rectangle (1). The center of axis 3 will cut an arc has a radius (J), the value of which will be calculated on the basis of a variable length depending on the shape to be given to this part of the shoe. On front axis (3) there is drawn a perpendicular (4) at a distance (E) from front small side (F) equal to 2/7 of the length of (A). On this perpendicular (4) there is situated the center of an arc having a radius (L) equal to 1/7 of the length of (A), which arc of radius (L) is tangent to another arc having a radius (X) and a variable magnitude, also tangent to the corresponding arc having a radius (P). This arc of radius (X) constitutes the inner zone of the shank and has a variable magnitude, depending on the criteria and conditions determined by the designer for the particular shoe model.

On the perpendicular 4 there is also positioned the center of an arc of radius (A) which is tangent to the arc of radius (L) and, in turn, also tangent to the arc having a radius (J) which forms the tip or toe.

At a distance (C) equal to 5/13 of the length of (A) there is drawn another perpendicular (5) which cuts the lower side of the main rectangle (1) at a point which is the center 8 of an arc of radius (F) equal to ⅓ the length of (A), which is tangent to another arc of radius (O) having a value 3/2 the length of (A) which, in turn, is tangent to the respective arc having a radius (P).

To complete the total contour of the sole, a straight line 6 is drawn through two points (7) and (8). Point (7) is on the outer larger side of the main rectangle (1) and spaced from the front smaller side by a distance (H) having a value of ¼ the length of (A), while point (i) is the point of intersection between the perpendicular (5) and the inner larger side of the main rectangle (1). On this straight line (6), which is formed between the two points (7) and (8), there is positioned the center of an arc of radius (A) which is tangent to the arc having a radius (F) and a center at (8), and also tangent to the arc of radius (J) which forms the toe.

The drawing of all these lines and their corresponding arcs defines the outline or contour of the sole having completely normalized measurements all proportionally related to the main measurement (A) which is the length or size measurement of the shoe.

Figure 2:
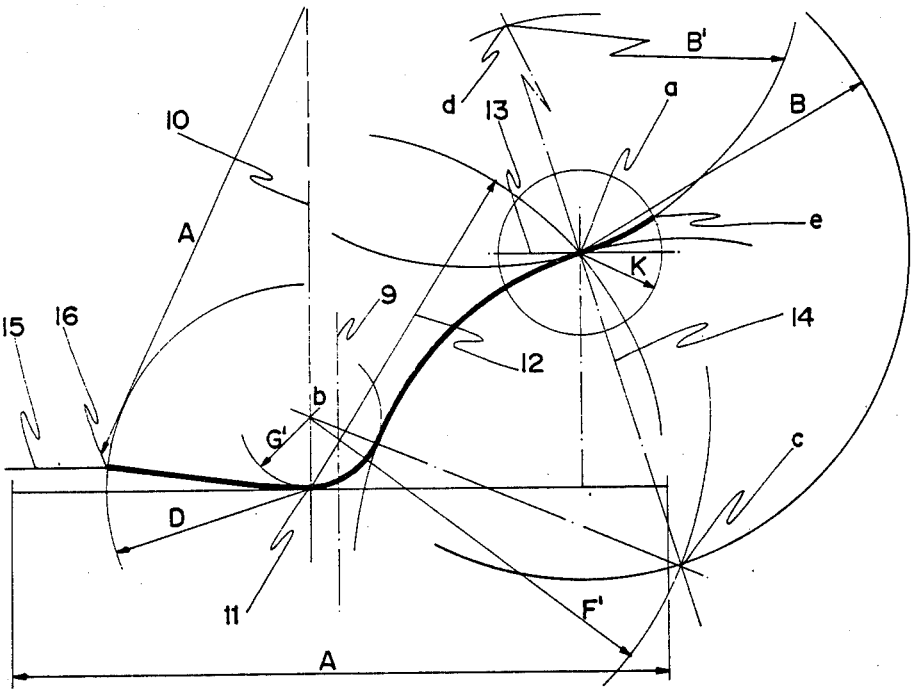
FIG. 2 is a graphic sectional view of the lower longitudinal profile thereof.

The graphic representation, as shown in FIG. 2, of the lower profile of the last is made with respect to a straight line having a magnitude (A) which is the length of the shoe, and through which is drawn an axis (9) perpendicular to the long straight line at its midpoint, as well as a line (10) parallel to axis (9) and positioned forwardly thereof at a distance having a value of 1/24 the length of (A), parallel (10) constituting the axis of the sole.

From the drawing of axes (9) and (10), and the point of intersection (11) between axis (10) and the straight (A) acting as the center of an arc having a radius (12) and a value 13/24 the length of (A), such arc is cut by a line (13) parallel to the straight line (A) and spaced therefrom by a distance equal to the height of the particular heel. The arc having a radius (12) and the straight line (13) form a point of intersection (a) which is the center of a circle having a radius (K) equal to ⅛ the length of (A) and which, at a rear portion thereof, will intersect the sole and limit the rear end thereof.

Subsequently, there is drawn an arc having a radius (G') equal to 1/9 the length of (A), with its center at a point (b) situated on the axis (10) of the sole, which arc of radius (G') is tangent to the straight line (A). There is drawn an arc having a radius (F') and a center at the point (b), which arc is intersected at a point (c) by another arc having a center at (a) and a radius (B) equal to ½ the length of (A). From intersection point (c) is drawn an arc tangent to the arc having a radius (G') and which terminates at the point (a), whereby the flexing portion of the sole is formed.

Subsequently a straight (14) is drawn through the points (c) and (a), which line is intersected at a point (d) by the arc having the radius B and a center at (a). The point (d) acts as a center for drawing an arc having radius (B') tangent to the flexing arc and which terminates when it is intersected by the circle having the radius (K).

Then there is drawn an arc having a radius (A) with a center on the axis (10) of the sole and which is tangent to the arc having radius (G') and a center at (b). Thereafter and from the point of intersection (11) between the axis (10) of the sole and the straight (A), an arc having radius (D) equal to 5/16 the length of (A) is drawn. Then is drawn a line (15) parallel to the straight line (A) at a distance therefrom 1/10 of the height of the heel, which parallel line (15) is intersected by the arc having the radius (D) and a center at point (11), at a point (16) from where a straight line is drawn tangent to the arc having the radius (A) and a center at the axis of the sole (10). Thereby, the toe or tip is completely formed, and the lower longitudinal profile of the last is completed.

Figure 3:
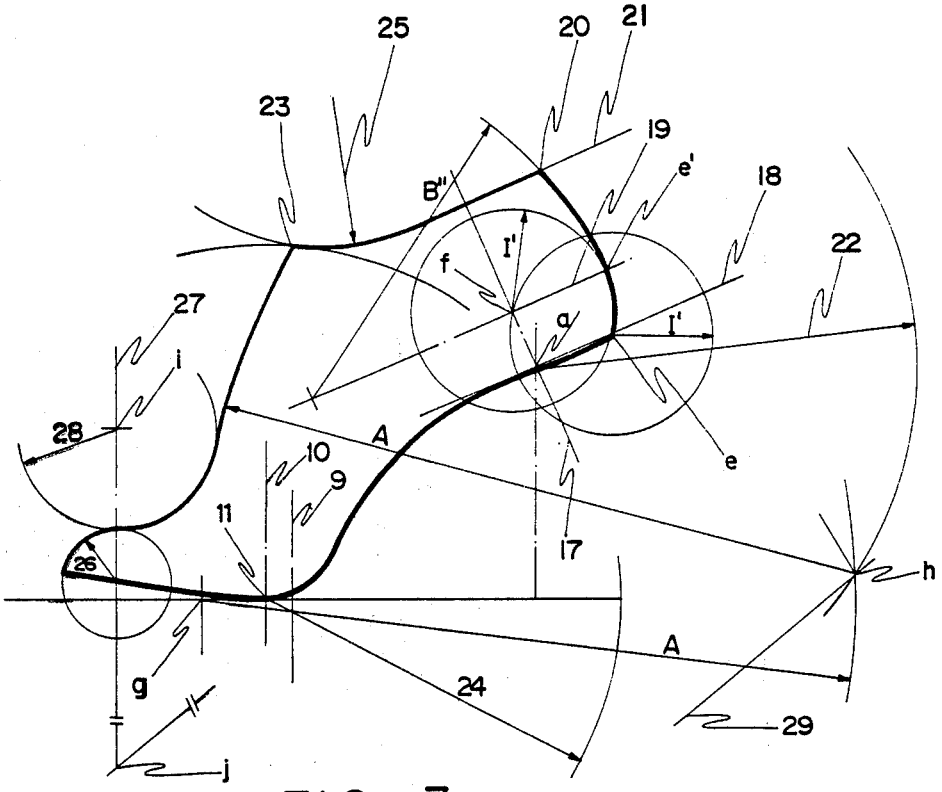
FIG. 3 is a graphic sectional view of the upper longitudinal profile thereof.

The upper longitudinal profile of the last is drawn departing from an already drawn lower longitudinal profile of the last, as will be described with reference to FIG. 3.

Specifically, a line (17) is drawn through the lower longitudinal profile of the last, through the point (a) and perpendicular to a straight line (18) which is tangent to the flexing arc and which passes through the rear point (e) of the lower profile. Then a circle having a radius (I') equal to 3/19 the length of (A) with a center at (e) is drawn, which circle is interested by the perpendicular (17) at a point (f) which acts as the center of another circle having radius (I') equal to 3/19 the length of (A), thus forming an arc which defines the lower zone of the rear part of the heel, and which is comprised between the point (e) and the point of intersection (e') between the circle having the radius (I') and a center at (f) and a line (19) which is parallel to the straight (18) and which passes through the point (f).

The upper zone of the heel is formed by an arc having radius (B'') equal to ½ that of (A) with a center on line (19). This arc which forms the upper zone of the heel is formed between the point (e') and a point (20) determined by the intersection between the arc of radius (B'') and a line (21) extending parallel to the tangent (18) and spaced by a distance equal 4/15 the length of (A) from the point (e').

To form the contour of the vamp, a point (g) is located at a distance equal to 1/10 the length of (A) forwardly of the axis (10) of the sole. From point (g) there is drawn an arc having radius (A) and which forms a point of intersection (h) with another circumference (22) having a radius 7/12 the length of (A) and a center at point (a). From point (h) there is drawn an arc having radius (A) which determines the curve of the vamp. The vamp is limited at the top by the crossing of a point (23) with a circumference having a radius (24) equal to 13/24 the length of (A) and with a center at the intersection point (11) of the straight line (A) with the axis (10) of the sole.

This upper zone of the vamp is then continued in an arc having a radius (25) equal to ⅓ the length of (A), which arc is tangent to the upper parallel line (21) and the front end of which terminates at the point of intersection (23) of the circumference having a radius (24) with the arc of the vamp, thus completing the mouth of the last.

The upper profile of the last is completed by drawing an arc having a radius (26) equal to 1/14 the length of (A) with a center on a straight line (27) which extends parallel to the axis (10) of the sole.

The parallel line (27) has a point (i) which acts as a center for an arc having a radius (28) which completes the upper profile, since it is tangent to the arc of the tip and to the arc of the vamp.

The point (i) is formed when points (h) and (j) are joined by means of a straight line 29. The point (j) is situated on the parallel line (27) at a distance equal to (A) from the point of intersection of the arc of the tip and the parallel line (27). At the mid-point of the straight line (29) which joints the points (j) and (h), there is drawn a perpendicular line which will be intersected by the parallel line (27) at the point (i) which will act as center for the arc having the radius (28) which will close the upper longitudinal profile of the last since this arc is tangent to the arcs of the vamp and the tip.

Since the rear part of the upper base of the heel is conditioned by the lower profile of the last, to initiate drawing of the profile of the heel, specifically the longitudinal profile thereof, it is necessary to depart from the drawing of the lower longitudinal profile of the last.

Figure 4:
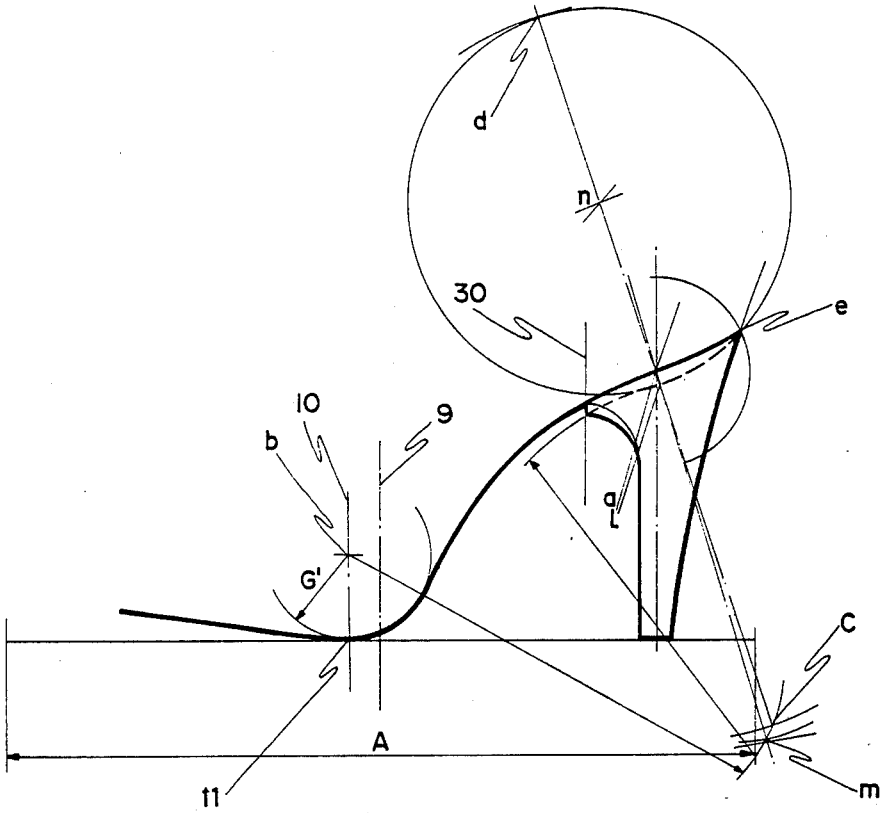
FIG. 4 is a graphic sectional view of the upper longitudinal profile of the heel thereof.

With reference to FIG. 4, on an oblique axis (d–c) which passes through the point (a), a point (L) is obtained at a distance from point a of 1/60 the length of (A), the point (L) being the center of an arc having a radius equal to ½ the length of (A). This arc will be intersected by another arc having a radius equal to 11/18 the length of (A) and with a center at (b). The intersection of these two arcs forms a point (m) which is the center of an arc having a radius equal to ½ the length of (A) and which is tangent to the arc having the radius (G'), whereby the arc which forms the forward portion of the concavity of the upper part of the heel is obtained.

Subsequently, from the point (e) of the lower profile of the last and from the point (L) are drawn arcs each having a radius equal to ¼ the length of (A), which arcs will intersect at a point (n) situated on the oblique axis (d–c). This point (n) will be the center of a circle which defines the rear portion of the concavity of the heel, the length of which is determined when there is drawn a circle having a center at the highest point of the box of the heel and a radius which can be adjusted at the will of the designer, but which will preferably have a value equal to 9/40 the length of (A) and which will intersect the flexing arc at a point through which a line (30), parallel to the axis of the heel, is drawn. The path of line (30) forms the forward zone of the box of the heel, the other measurements of which are adjustable according to the characteristics of the shoe which will be determined by the designer.

With reference now to FIGS. 5–14, the features of the present invention will be described.

The main measurements of the sole of the last corresponding to the transverse arching thereof, as shown in FIG. 5, are obtained by drawing a transverse axis (31) at a position spaced by ⅓ the length of (A) from the tip or toe. Subsequently, forwardly of the transverse axis (31) there are defined four zones by three transverse lines (32), (33) and (34) which are equally spaced from one another by distances equal to 1/12 of the length of (A).

The sections of the sole defined at lines (32), (33) and (34) are flat at line (32), an arc with a rise (35) having a value equal to 1/120 the length of (A) at line 33, and an arc with a rise (36) having a value equal to 1/96 the length of (A) at line (34).

Rearwardly of the transverse axis (31), there are drawn seven transverse lines (37), which are equally spaced from one another by distances equal to 1/12 the length of (A). The section of the sole defined at the line (37) nearest to the axis (31) is an arc (38) with a rise equal to 1/96 the length of (A). The contours of the sole defined at the remaining lines (37) are arcs (39) each having a rise equal to 1/60 the length of (A).

This arrangement proportions the complete range of sizes corresponding to the transverse arching of the sole of the last.

The primary sizes of the sections of the last corresponding to the edges thereof, the heel, the heelpiece, the mouth, the flexing zone and the upper and lower vamp, are defined as follows.

Figure 7:
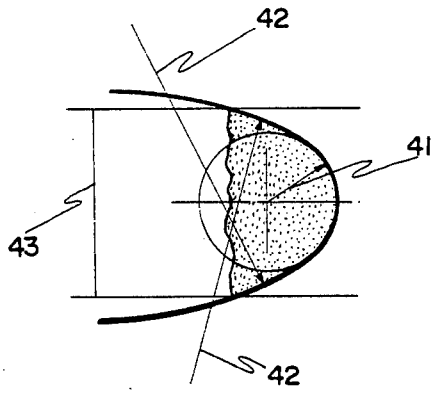
FIGS. 7, 8, 9, 10, 11, 12, 13 and 14 are graphic sectional views of the edges of the last in accordance with various sections taken through FIG. 6.

The section of the heel, as defined at a distance (40) equal to 1/16 the length of (A) from the base of the heel (see FIG. 6), is defined by an arc having a radius (41) equal to 1/16 the length of (A) with a center on the longitudinal axis and on opposite sides by two arcs each aving a radius (42) equal to ½ the length of (A), for a distance (43) from the longitudinal axis equal to 1/12 the length of (A), from where the section is prolonged by tangent arcs, the radius of each of which is adjustable at the will of the designer (see FIG. 7 which is a section along A-B in FIG. 6).

Figure 8:
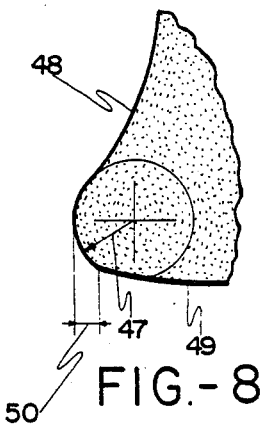
Figure 11:
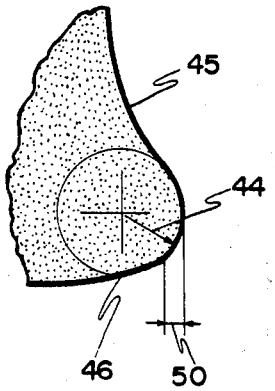
Figure 12:
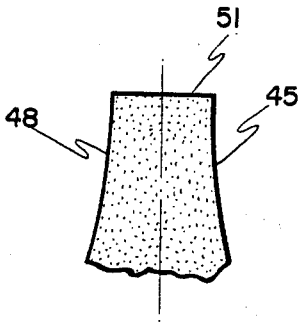
Figure 13:
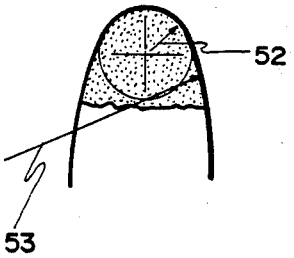
Figure 14:
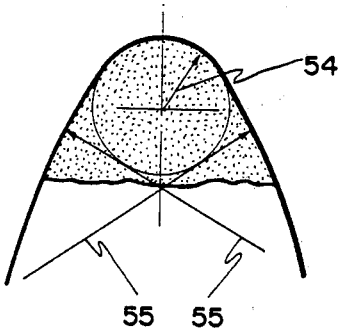

The inner side section of the heel, see FIG. 11, is defined by an arc having a radius (44) equal to 1/20 the length of (A) and which is tangent to an upper arc (45) which can be varied at will and which constitutes the inner side of the last. The arc of radius (44) furthermore is secant to an arc (46) corresponding to the sole of the last. The outer side section of the heel, see FIG. 8, is defined by an arc having a radius (47) equal to 1/17 the length of (A) and which is also tangent and secant, respectively, to an upper arc (48) of the last and an arc (49) of the sole. On both arcs having radii (44) and (47) there is a point which is separated from the edge of the sole by a distance (50) equivalent to 1/20 the length of (A).

The mouth section (see FIG. 12) has a central transverse width (51) equivalent to 1/11 the length of (A).

The upper section of the vamp (see FIG. 13) is defined by an arc having a radius (52) equivalent to 1/26 the length of (A) and which is tangent to arcs each having a radius (53) equal to 1/5 the length of (A) and which in turn are tangent to the sides of the last. The lower section of the vamp (see FIG. 14) is defined by an arc having a radius (54) equal to ⅛ the length of (A), and which is tangent to arcs each having a radius (55) equal to ½ the length of (A), which in turn are tangent to the sides of the last.

Figure 9:
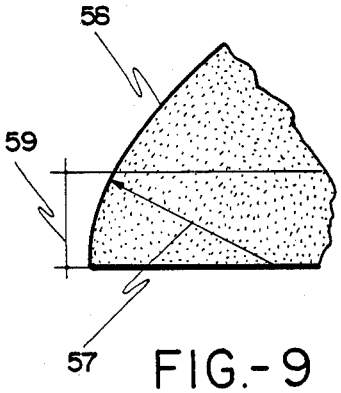
Figure 10:
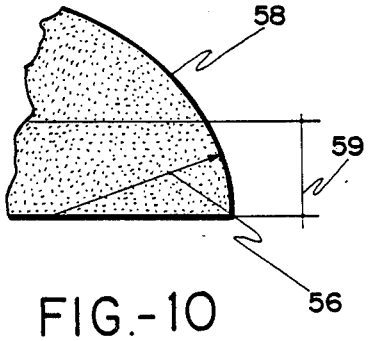

The section of the flexing zone is defined, at its inner edge (see FIG. 10), by an arc having a radius (56) equal to 1/6 the length of (A), and at its outer edge by an arc having a radius (57) equal to 1/7 the length of (A) (see FIG. 9). The arcs of radius (56) and (57) both are tangent to points of side arcs (58) at positions spaced from the sole by a distance (59) equivalent to 1/12 the length of (A).

Drawing or defining all these sections or contours of the edges of the last completes the last, the main measurements of which are related and proportional to one another and have been derived from two only size or measurement parameters, i.e., the length of the last and the height of the heel.

Further, all the measurements corresponding to the transverse arching of the sole and to the edges of the last do not undergo any modification if the height of the heel is varied. Rather, all of the measurements are invariable since the height of the heel only proportions the last with a greater or lesser degree of inclination with respect to the flexing zone, which will vary in position but not with respect to measurements.

This process of manufacturing shoes proportions properly all the measurements of the shoe with respect to only some of them, whereby final products are obtained which will perfectly and anatomically adapt to the foot. Furthermore, proportioning properly all models and sizes of shoes will permit a greater and easier machining of all the elements forming the shoe, resulting in the reduction of the manufacturing costs thereof.

I claim:

1. A process for the normalized manufacture of shoes, such that as shoe lengths change, other shoe dimensions are changed proportionally, said process comprising contouring shoe lasts used for shoe manufacture such that for each shoe last the sole of the last is dimensioned by:

defining an axis extending transverse to the length of said sole of said last at a position spaced from the front of said sole by one-third the length of said sole;

defining four forward sole zones separated by three lines extending transverse to said length and spaced bewteen said front and said axis by equal intervals of 1/12 said length;

forming said sole at a first said transverse line closest to said front to have a straight contour along said first transverse line;

forming said sole at a second said transverse line rearwardly adjacent said first transverse line to have a regularly arched contour having a height of 1/120 of said length;

forming said sole at a third said transverse line closest to said axis to have a regularly arched contour having a height of 1/96 of said length;

defining eight rearward sole zones separated by seven rear lines extending transverse to said length and spaced between said axis and the heel of said sole by equal intervals of 1/12 said length;

forming said sole at a first said rear transverse line closest to said axis to have a regularly arched contour having a height of 1/96 of said length; and forming said sole at each of the remainder of said rear transverse lines to have a regularly arched contour having a height of 1/60 of said length.

2. A process as claimed in claim 1, further comprising forming the contour of said heel to be defined by, at a plane spaced from the base of the heel by a distance equal to 1/16 said length, a first arc having a radius equal to 1/16 said length and centered on the longitudinal axis of said heel, a pair of second arcs tangent to said first arc, each said second arc having a radius equal to one-half said length and extending until the distance between said second arcs is equal to 1/12 said length, and a pair of third arcs each having a selectively variable radius and extending tangent to a respective said second arc.

3. A process as claimed in claim 2, further comprising forming the contour of the inner side of said heel and the contour of the outer side of said heel to be defined respectively by an arc having a radius equal to 1/20 said length and extending tangent to a selectively variable arc of the inner side of said last and secant to an arc of said sole, and by an arc having a radius equal to 1/17 said length and extending tangent to a selectively variable arc of the outer side of said last and secant to said arc of said sole.

4. A process as claimed in claim 1, further comprising forming the contour of the mouth of said last to have a transverse width, at the longitudinal midpoint thereof, equal to 1/11 said length.

5. A process as claimed in claim 1, further comprising forming the contour of an upper portion of the vamp of said last and the contour of a lower portion of said vamp of said last to be defined respectively by a first arc having a radius equal to 1/26 said length and a pair of second arcs tangent to said first arc and each having a radius equal to 1/5 said length and tangent to a respective side of said last, and by a third arc having a radius equal to 1/8 said length and a pair of fourth arcs tangent to said third arc and each having a radius equal to one-half said length and tangent to a respective said side of said last.

6. A process as claimed in claim 1, further comprising forming the contour of the inner side of the flexing zone of said last and the contour of the outer side of said flexing zone to be defined respectively by an arc having a radius equal to 1/6 said length, and by an arc having a radius equal to 1/7 said length, both said arcs being tangent to respective sides of said last at positions spaced from said sole by a distance equal to 1/12 said length.

* * * * *